US007119820B2

(12) United States Patent
Montgomery

(10) Patent No.: US 7,119,820 B2
(45) Date of Patent: Oct. 10, 2006

(54) SCANNING HEADS

(75) Inventor: Trevor Montgomery, Bushey (GB)

(73) Assignee: Quad/Tech, Inc., Sussex, WI (US)

( * ) Notice: Subject to any disclaimer, the term of this patent is extended or adjusted under 35 U.S.C. 154(b) by 12 days.

(21) Appl. No.: 10/756,800

(22) Filed: Jan. 13, 2004

(65) Prior Publication Data

US 2004/0175093 A1 Sep. 9, 2004

(30) Foreign Application Priority Data

Jan. 14, 2003 (GB) ..... 0300782.0

(51) Int. Cl.
*B41J 2/385* (2006.01)

(52) U.S. Cl. ..... 347/116; 101/481; 235/462

(58) Field of Classification Search ..... 235/462; 101/481; 347/116
See application file for complete search history.

(56) References Cited

U.S. PATENT DOCUMENTS

| | | | | |
|---|---|---|---|---|
| 3,873,213 A | | 3/1975 | Plumadorf | |
| 3,992,100 A | | 11/1976 | Lodzinski et al. | |
| 4,289,405 A | | 9/1981 | Tobias | |
| 4,333,112 A | | 6/1982 | Matsumoto | |
| 4,859,842 A | * | 8/1989 | Suda et al. | 250/201.8 |
| 5,349,199 A | * | 9/1994 | Rabjohns et al. | 250/559.29 |
| 5,642,226 A | * | 6/1997 | Rosenthal | 359/619 |
| 6,246,658 B1 | | 6/2001 | White et al. | |
| 6,717,168 B1 | * | 4/2004 | Eisen et al. | 250/559.36 |
| 6,805,449 B1 | * | 10/2004 | Hecht | 353/85 |
| 6,817,525 B1 | * | 11/2004 | Piva et al. | 235/454 |

FOREIGN PATENT DOCUMENTS

| | | | |
|---|---|---|---|
| EP | 0184907 | | 6/1986 |
| EP | 0403082 | | 12/1990 |
| EP | 8367299 | | 11/1992 |
| EP | 0817467 | | 1/1998 |
| EP | 0906827 | | 4/1999 |
| EP | 0909646 | | 4/1999 |
| EP | 1352741 | | 10/2003 |
| GB | 1507938 | | 4/1978 |
| GB | 2351558 | | 1/2001 |
| JP | 05269976 | | 10/1993 |
| JP | 06191019 | * | 7/1994 |
| WO | WO 87/06190 | | 10/1987 |
| WO | WO 99/63529 | | 12/1999 |

* cited by examiner

*Primary Examiner*—Daniel J. Colilla
*Assistant Examiner*—Marissa Ferguson-Samreth
(74) *Attorney, Agent, or Firm*—Michael Best & Friedrich LLP

(57) ABSTRACT

A scanning head for use in a register mark detection apparatus for detecting register marks on a web during relative movement between the web and the scanning head. The scanning head comprises an optical sensor and a first optical mask spaced from the optical sensor and having an aperture therethrough to define the viewing footprint of the optical sensor. In some embodiments, the scanning head also includes a second optical mask in series with the first optical mask. The scanning head is versatile and capable of operating with high sensitivity and accuracy even with low contrast media, including with embossed or relief marks, or for fold-line registration or with translucent media.

17 Claims, 1 Drawing Sheet

SCANNING HEADS

CROSS-REFERENCE TO RELATED APPLICATIONS

This application claims priority to co-pending UK Patent Application No. 0300782.0, filed Jan. 14, 2003, the entire contents of which is incorporated by reference herein.

FIELD OF THE INVENTION

The present invention concerns improvements in and relating to scanning heads such as, for example, those used in the print industry for detection of print registration marks or for fold-line registration.

BACKGROUND OF THE INVENTION

As in many other industries, it is desirable in the printing industry to simplify the design of equipment used to ensure efficient operation and cost savings. One area where technological advances afford cost savings is in the design of the printing press and print registration equipment. Through enhancements to the print registration equipment, considerable savings have been achieved while reliably ensuring that each of the color-global change layers in a four color print process are printed in register with each other as they are sequentially applied to the print web, and minimizing the wastage in each print run. In some equipment, one or more arrays of optical sensors are deployed in one or more scanning heads overlying the print web to detect the print registration marks on the print web and a processor linked to the scanning heads monitors the signals from the sensors and determines when a sensor or group of sensors has sensed the passage of a print registration mark.

Although much improvement has been obtained in the operational efficiency and effectiveness of the print registration equipment, the hardware costs have not been as effectively addressed. It is, accordingly, desirable to provide for a more economical construction of print registration equipment while maintaining the high standards of accuracy and reliability that the print industry has come to expect and require. It is further desirable to provide for a more compact construction of print registration scanning head.

SUMMARY OF THE INVENTION

The present invention provides a scanning head suitable for use with a printing press in a register mark detection apparatus. More specifically, the scanning head includes an optical sensor and a first optical mask spaced from the optical sensor. The first optical mask has an aperture therethrough to define the viewing footprint of the optical sensor.

In one embodiment, the scanning head also includes a second optical mask with an aperture in series with the aperture of the first mask. In another embodiment, the scanning head includes a light source arranged in the scanning head to provide direct reflection illumination of a substrate. In another embodiment, the scanning head includes a light source arranged to provide diffuse illumination of the substrate. In yet another embodiment, the spacing between the first mask and the second mask is of the order of ten times greater than the spacing of the first mask from the substrate.

Other features and advantages of the invention will become apparent to those skilled in the art upon review of the following detailed description, claims, and drawings.

Figure 1:
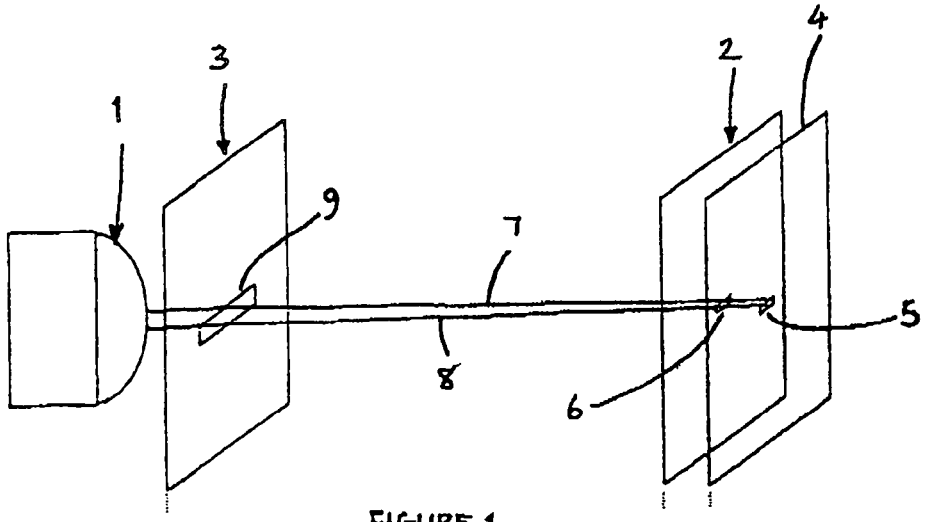
FIG. 1 is a schematic view of components of a scanner head according to the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including," "having," and "comprising" and variations thereof herein is meant to encompass the items listed thereafter and equivalents thereof as well as additional items.

DETAILED DESCRIPTION

FIG. 1 illustrates a scanner head according to the invention, showing a scanning head optical sensor 1, such as a photosensitive diode, positioned over a printed paper substrate, such as a web 4, to receive light reflected back from a small viewed footprint 5 of the web 4 that is suitably overlying and only marginally larger than the footprint of the registration mark on the web 4. The sensor 1 has a high forward gain and a narrow beam width (e.g., 10°) and uses a pair of optical masks 2,3 positioned between the optical sensor 1 and the web 4 to block stray light from reaching the sensor 1.

The masks 2,3 each have a respective aperture 6,9 so that as the registration mark passes adjacent the sensor 1, the sensor 1 receives only light reflected back from the small viewed footprint 5 of the web 1 corresponding to the approximate footprint of the registration mark on the web 4. Each of the apertures 6,9 is shown as being an elongated slot-shaped aperture, corresponding to the shape of the registration marks used on the print web 4. However, it is understood that the shape of the apertures could be any shape that allows the reflected registration mark to reach the sensor 1.

For the first mask 2 that is closest to the web 4, the size of the aperture 6 is substantially the same size as the viewed footprint 5 on the web 4. The first mask 2 is positioned in a plane parallel to the web 4 and is spaced a short fixed distance (on the order of a few mm) from the web 4. The first mask 2 is responsible for primary discrimination of the registration mark and is almost totally in focus as a result of being so close to the print web 4. In the illustrated example, the first mask 2 is spaced only 4 mm from the web 4 and has an aperture 6 of 0.5×0.8 mm corresponding to a viewed footprint 5 of 0.5×0.8 mm. During a print run, the print web 4 experiences an oscillatory movement, known as print flap, that cyclically varies the spacing of the first mask 2 from the web 4 by a magnitude dictated by the mass, tension, and rate of travel of the moving print web 4. The preferred scanning head positioning height tolerance (tolerance of spacing of the first mask 2 from the print web 4) in the illustrated embodiment is 3 mm+/−1 mm.

The second mask 3 is positioned within a few mm of the sensor 1 and approximately 40 mm away from the first mask 2. The second mask 3 is aligned with the first mask 2 and the sensor 1 so that the light reflected from the print web 4, having passed through the aperture 6 of the first mask 2, must then pass through the aperture 9 of the second mask 3 to fall onto the sensory surface of the sensor 1. The second mask 3 restricts the light input to the sensor 1, while still allowing sufficient light for a good signal to noise ratio. Since the final optical footprint will generally be small and non-circular, unlike the large diameter circular receiving lens/sensing surface of the sensor 1, the second mask 3 will help optimize the match between the footprint defined by the first mask 1 and the large diameter circular receiving lens/sensing surface of the sensor 1.

Figure 2:
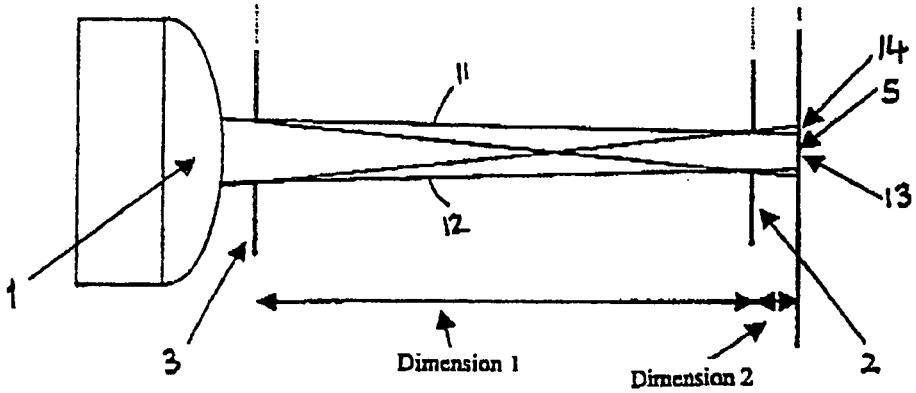
FIG. 2 is a plan view of the arrangement shown in FIG. 1.

As shown in FIG. 1, the light reflected from the web 4 is restricted by the first mask 2 to a beam demarcated within upper 7 and lower 8 boundary lines. In the plan view of FIG. 2 the lateral boundaries of the beam are demarcated by boundary lines 11,12. The umbra 13 and the penumbra 14 of the target footprint/imaged area 5 on the print web 4 crossover as the light passes through the aperture 6.

To optimize the overall sensitivity and selectivity of the receiver, the area of aperture 9 of the second mask 3 is scaled up relative to the area of the first mask's aperture 6 in correspondence with the ratio of Dimension 1 (the distance between masks 2,3) to Dimension 2 (the scanning head height above the web 4) and which is preferably of the order of 10:1. Given that in the illustrated example Dimension 1 is 40 mm and Dimension 2 is 4 mm, and that the area of aperture 6 is 0.5×0.8 mm, the selected size of the aperture 9 is suitably 1×4 mm, i.e., ten times larger than the area of aperture 6. By appropriate selection of the sizes of the mask apertures 6,9 and the ratio of Dimensions 1 and 2, the viewed footprint 5 is reduced to a very small area.

Further optimization is obtained by shaping the apertures 6,9 to the shape of the registration mark to be detected. The illustrated 0.5×0.8 mm aperture 6 of the first mask 2 may, for example, without changing the overall viewed footprint area 5, be adjusted to a 0.1×4 mm slit suitable for use where the print registration mark is a line. For a star-shaped print registration mark, the aperture 6 would suitably also be star-shaped. The aperture 6 could be comprised of an array/grouping of small apertures configured to replicate an array/group of discrete elements or lines comprising a composite print registration mark. For example, there may be two parallel slots comprising the aperture 6 in the mask 2 to correspond to two parallel lines of a print registration mark on the print web 4, and this will provide even higher reliability of print registration than a single slot corresponding to a single line mark. For adaptability in use the apparatus is suitably configured for interchangeability of the mask 6, and suitably also of mask 9, with replacement masks having alternative shapes and/or configurations of aperture. This can yet further enhance the reliability of registration mark detection.

Figure 3:
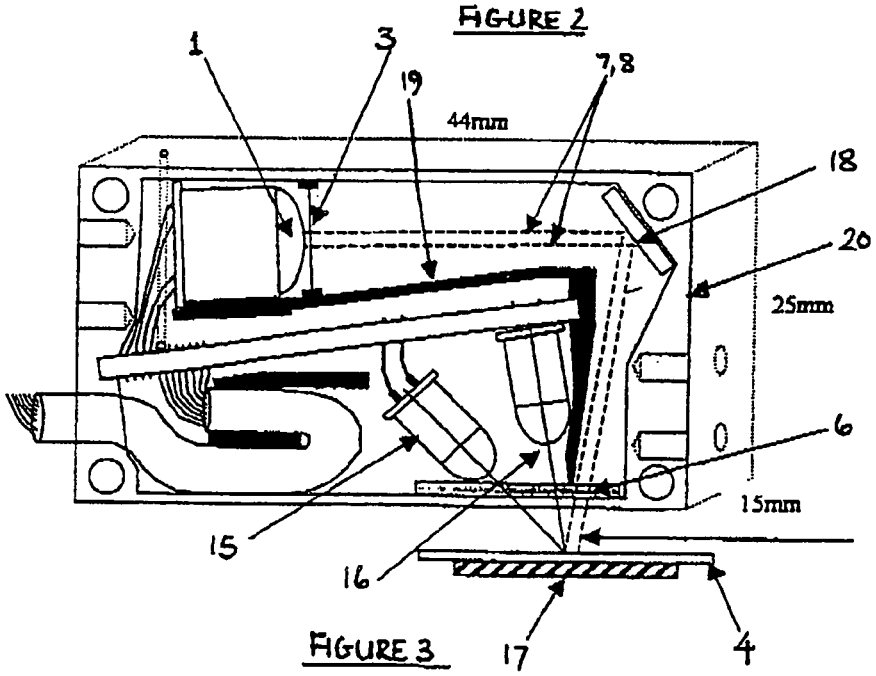
FIG. 3 is a schematic view of the components assembled together in a working scanner head.

In contrast to the conventional scanning heads, there is no focussing lens or mirror spaced away from the optical sensor 1 to focus the light onto the optical sensor 1, although the sensor 1 may, as illustrated, have a small integral receiving lens instead of a separate lens or focussing mirror. Referring to FIG. 3, the illustrated embodiment of the scanning head has a compact construction with the sensor 1 and masks 2,3 held within a housing 20 in the same relative positions as in FIGS. 1 and 2 but with the line between the first mask 2 and second mask 3 folded by a simple non focussing mirror 18, to render the head even more compact. For optimal versatility, one or more of the sensor 1 and masks 2,3 may be demountable from the housing 20 and/or adjustable in position within the housing 20 to allow the user to tune the head for a particular requirement.

To illuminate the viewed footprint area 5 of the print web 4, the scanning head has, as a light source, a pair of wide angle light-emitting diodes (LEDs) 15,16 mounted within the housing adjacent the receiving components (sensor 1 and masks 2,3) but shielded from them by a barrier wall 19. These two LEDs 15,16 can be substantially identical, emitting light of the same wavelength and intensity as each other, but differ in their mounting angles within the housing 20 to enable the scanning head to have two primary different modes of operation. However, it is understood that in other embodiments, the LEDs can emit light of different wavelengths, and/or different intensities from each other.

The first LED 15 is mounted within housing 20 for diffuse mode operation with its axis tilted at 45° to the normal of the bottom face of the housing 20, thereby being at 45° to the normal of the web 4, since the bottom face of the housing 20 is plane parallel to the web 4. This first LED 15 has no direct reflective path via the scanned media/print web 4 into the optical receiver window through the aperture 6 of the first mask 2. It functions to provide a diffused light source for the scanning operation that is particularly suitable for registration mark detection on printed paper, holograms and embossed media.

The second LED 16 is mounted within housing 20 for direct reflection mode operation with its axis tilted at 10° to the normal of the bottom face of the housing 20, thereby being at 10° to the normal of the web 4 and facilitating direct reflection from the web 4 into the optical receiver window. This LED 16 is particularly useful for scanning reflective media or printed marks on transparent media. In the latter case, a mirror backing plate 17 positioned underlying the transparent media may be used to reflect the light to the optical receiver window. In operation of the second LED 16, the angle of incidence and angle of reflection through the optical path from the transmitter light source LED 16 to the optical light aperture 6 are equal. The scanner head height and position of the LEDs are suitably arranged so that the area of the print web 4 illuminated by the LEDs is of sufficient size to accommodate the viewed footprint/mask aperture 6 footprint, with additional allowance being made for the scanner head height tolerance and web flap referred to earlier.

The scanning head is configured to enable switch selection between the light sources and modes of operation with the first or second LED 15,16 being selected dependent upon the media to be scanned. Indeed, a mix of light from both first and second LEDs 15,16 simultaneously may be used to suit some media and for greatest versatility, the wavelengths and intensities of the light sources are suitably adjustable. For this the first and second LED 15,16 may each be part of a respective group of LEDs, one group at the 10° angle or a similar angle for direct reflection operation and the other at the 45° angle or a similar angle for diffused light operation, with LEDs within each group differing in wavelength output from each other and individually selectable for use alone or in combination with others. One of the LEDs in each group may, for example, emit one specific visible spectrum colored light, e.g., red, while another emits a different specific visible spectrum colored light, e.g., green, or even, in one particularly preferred arrangement, UV light when the sensor 1 incorporates a UV optical receiver.

A white light LED can alternatively be used when the receiving optical sensor 1 is an eye color response detector adapted to sense light across the whole visible spectrum.

Where the LED emits one, specific visible spectrum colored light, the color suitably is in contrast to the media under view to increase detection sensitivity, allowing detection of vary pale shades. Single or multiple combinations of colors may be used, to optimize the contrast with the media under view. Alternatively or additionally, varnishes, lacquers, cold seals, glues and other clear media may be scanned using a white light emitting LED, adjusting the light level from the LED appropriately.

A UV based detection system enables registering of UV reflective clear inks, varnishes lacquers, cold seals, glues and other clear media that cannot readily be registered with conventional visible light based systems. The provision of a UV emitting LED and corresponding receiver in a scanning head of the present invention is especially useful since it provides an exceptionally cost effective UV detection system, with the masks 2.3 avoiding the need for multiple quartz lenses and still enabling the scanning head to focus on a very small media marks.

In operation of the scanning head as part of a print registration detection apparatus, or for other purposes, the scanning head function can be met through controlled illumination. With the general exception of UV mode, the parameters of the optical sensor remain the same for the different modes.

In general, the analog output signal of the receiver/sensor is proportional to the contract ration and/or embossed relief profile of the scanned media as viewed within the viewing footprint of the sensor. To allow for differences in contrast and reflectivity of different media, the analog output signal of the receiver/sensor is suitably gain-controlled. In the example of a print registration detection apparatus, the linear travel of the web gives rise to a sensor signal that varies with time as the registration mark comes into view and then passes the scanning head. The analog sensor output signal is normally converted to a digital signal by an AD converter and then analyzed by a processor and/or software that is normally a part of the print registration detection apparatus or at least operatively linked to it, to discriminate the characteristics of different print registration marks and activate subroutines/controllers for positional feedback control of the printing press. In some systems, the analog signal can be analyzed by an analog processor.

As noted above, the scanning head of the present invention provides a highly effective system for a print registration in a printing press. The assembly is simple, efficient, effective, versatile and very economical both to install and run, is lightweight, is very compact and may readily be used in explosion risk environments, and achieves high standards of accuracy and reliability with a wide range of media. Indeed, the ability to manufacture the masks 2,3 to close tolerances enables even greater accuracy in defining optical rise and fall times than conventional registration detection apparatus, giving greater accuracy in the registration measurement.

Various features of the invention are set forth in the following claims.

The invention claimed is:

1. A scanning head suitable for use with a printing press in a print register mark detection apparatus for detecting print register marks on a web substrate, the scanning head comprising:

a first light source for providing selective diffuse illumination of a web substrate;

a second light source for providing selective direct reflection illumination of the web substrate;

an optical mask having an aperture therethrough and passing light reflected from the web substrate;

an optical sensor for receiving light passing through the aperture; and a means for selecting between operation of the first light source, the second light source, or both light sources;

wherein in the selecting means, the selection of the light sources is dependent upon the type of web substrate.

2. The scanning head of claim 1, wherein at least one of the first and second light sources includes LEDs.

3. The scanning head of claim 1, wherein at least one of the first and second light sources emits one of white light and UV light.

4. The scanning head of claim 1, wherein one of the intensity and wavelength of at least one of the first and second light sources is adjustable.

5. The scanning head of claim 1, wherein the first light source includes an axis oriented at 45 degrees with respect to a plane perpendicular to the web substrate.

6. The scanning head of claim 1, wherein the second light source includes an axis oriented at 10 degrees with respect to a plane perpendicular to the web substrate.

7. A scanning head suitable for use with a printing press in a print register mark detection apparatus for detecting register marks on a web surface, the scanning head comprising:

an optical sensor;

a first optical mask spaced from the optical sensor, the first optical mask having an aperture therethrough;

a second optical mask with an aperture in series with the first mask, the apertures of the first and second masks together defining the viewing footprint of the optical sensor;

a first light source for providing selective diffuse illumination of a web substrate;

a second light source for providing selective direct reflection illumination of the web substrate; and a means for selecting between operation of the first light source, the second light source, or both light sources;

wherein in the selecting means, the selection of the light sources is dependent upon the type of web substrate.

8. A scanning head as claimed in claim 7, wherein the second mask is between the first mask and the sensor, and wherein the second mask is closer to the sensor than to the first mask.

9. A scanning head as claimed in claim 7, wherein the area of the aperture of the second mask is greater than that of the first mask.

10. A scanning head as claimed in claim 9, wherein the ratio between the area of the aperture of the second mask and the area of the aperture of the first mask is substantially the same as the ratio of the spacing of the first and second masks relative to the spacing of the first mask from the surface.

11. A scanning head as claimed in claim 7, wherein the aperture of at least one of the first and second masks is of a shape that is the same as or similar to the shape of the registration mark sought on the web surface.

12. A scanning head as claimed in claim 11, wherein the aperture of at least one of the first and second optical masks comprises multiple holes or slits.

13. A scanning head as claimed in claim 7, wherein the scanning head is configured to enable demounting of either of the first or second masks to allow for interchanging of masks with different aperture shapes or sizes.

14. The scanning head of claim 7, wherein at least one of the first and second light sources emits one of white light and UV light.

15. The scanning head of claim 7, wherein one of the intensity and wavelength of at least one of the first and second light sources is adjustable.

16. The scanning head of claim 7, wherein the first light source includes an axis oriented at 45 degrees with respect to a plane perpendicular to the web substrate.

17. The scanning head of claim 7, wherein the second light source includes an axis oriented at 10 degrees with respect to a plane perpendicular to the web substrate.

* * * * *